United States Patent [19]

Goodacre et al.

[11] Patent Number: 4,695,198

[45] Date of Patent: Sep. 22, 1987

[54] LIP-TYPE SEALING SYSTEM FOR A REMOVABLE BOTTOM FOUNDED STRUCTURE

[75] Inventors: John H. Goodacre, Glen Ellyn; Eric Brogren, Wheaton, both of Ill.

[73] Assignee: Chevron Research Company, San Francisco, Calif.

[21] Appl. No.: 866,825

[22] Filed: May 23, 1986

[51] Int. Cl.[4] ..... E02B 17/02

[52] U.S. Cl. ..... 405/224; 114/296; 405/195; 405/204

[58] Field of Search ..... 405/195, 203, 204, 207, 405/208, 224; 114/296; 277/34, 34.3, 34.6, 226; 49/477

[56] References Cited

U.S. PATENT DOCUMENTS

| | | | |
|---|---|---|---|
| 2,530,160 | 11/1950 | Finley . | |
| 2,657,661 | 11/1953 | Robson | 114/201 |
| 2,686,343 | 1/1951 | Harpoothian et al. . | |
| 2,720,011 | 5/1951 | Krupp . | |
| 2,937,006 | 5/1960 | Thayer . | |
| 3,348,517 | 10/1967 | Johnson et al. | 114/296 |
| 3,494,136 | 2/1970 | Wilms | 405/147 |
| 3,520,543 | 7/1970 | Etter et al. | 114/296 X |
| 3,701,500 | 10/1972 | Zeffer et al. | 244/103 R |
| 3,892,287 | 7/1975 | Bennett | 180/115 |
| 3,896,628 | 7/1975 | Hansen | 405/207 |
| 3,961,490 | 6/1976 | Corgnet . | |
| 4,155,671 | 5/1979 | Vos | 405/203 |
| 4,425,055 | 1/1984 | Tiedemann | 405/217 |
| 4,521,133 | 6/1985 | Suzuki et al. | 405/195 |
| 4,522,532 | 6/1985 | Fedrick | 405/195 X |
| 4,576,518 | 3/1986 | Cooke et al. | 405/203 X |

FOREIGN PATENT DOCUMENTS

| | | | |
|---|---|---|---|
| 2247377 | 6/1975 | France | 114/296 |

OTHER PUBLICATIONS

A Della Greca, "New Concept of Offshore Drilling/-Production Arctic Platform and Dynamic Analysis . . . " 2/12-17/84, ASME, 1984.

Buslov et al., "Detachable Systems—Alternative Approach for Arctic Exploratory Structures", pp. 519-529.

Stenning et al., "Arctic Offshore Deepwater Ice Structure Interactions", OTC 3630, pp. 2356-2365.

G. Sebastiani et al., "Offshore Drilling and Production Platforms with Rapid Removal and Redeployment . . . ", pp. 631-642.

*Primary Examiner*—Dennis L. Taylor

*Attorney, Agent, or Firm*—E. J. Keeling; P. L. McGarrigle; V. A. Norviel

[57] ABSTRACT

The Removable Bottom Founded Structure (RBFS) is an offshore platform for petroleum drilling and producing operations intended for depolyment in waters with severe weather and iceberg conditions. The structure is normally held down by gravity, but during the deballasting procedure a hold-down system is employed to keep the platform on the subbase until site evacuation. The system that is used to hold the platform down onto the subbase is located where the platform meets the subbase. It operates on the principle of hydrostatics. On the underside of the columns there are multiple chambers which may be evacuated by pumping and which are vented to the outside atmosphere. Flexible seals that define these chambers are positively engaged by this evacuation to create a fluid-tight seal so that no seawater will enter the evacuated chambers. The reduction of the buoyancy forces will hold the platform onto the subbase until such time as the platform is totally deballasted. Once that has occurred, the hydrostatic hold-down system is disengaged and the platform will quickly rise to the surface.

8 Claims, 8 Drawing Figures

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

LIP-TYPE SEALING SYSTEM FOR A REMOVABLE BOTTOM FOUNDED STRUCTURE

CROSS REFERENCE TO RELATED APPLICATIONS

This application is related to applications having the problem numbers: Ser. Nos. 869,524, 839,492, 835,419, 835,420, 869,525, and 898,989, all assigned to the assignee of this application.

FIELD OF THE INVENTION

This invention generally relates to offshore oil drilling and producing structures. More specifically, to a sealing/hold-down system that is used on a structure for removably detaching that structure from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these conditions, many different types of platform designs have arisen in an attempt to cope with the harsh weather and other natural elements.

Currently, much exploration is being conducted in the arctic and in the ice-infested waters off Alaska, Canada, and Greenland. To cope with the iceberg and weather problem, some structures attempt to resist these large ice masses by simply being large enough to withstand the crushing forces. Examples of these designs may be seen in dual cone structures, such as U.S. Pat. No. 4,245,929, large reef-like structures, or many other gravity based large concrete-steel configurations, see also U.S. Pat. No. 4,504,172. However, these structures are either too heavy expensive, or are permanently affixed to the bottom. As such, they do not lend themselves to either reuse or quick site evacuation in the case of an emergency situation.

Another design is a tension-leg platform (TLP) with disengageable or extensible legs as described in U.S. Pat. Nos. 3,955,521 and 4,423,985. These too have their inadequacies. The TLP maintains a stable floating position by its own buoyancy and the tendons that connect the structure to the sea floor. The allowable deck load for the TLP is limited due to its available buoyancy. Furthermore, there may be problems with icebergs that have drafts large enough to scour the sea floor. Most TLP structures have exposed wellheads and anchoring systems and thus would incur substantial damage if an iceberg of this size came along. Additionally, since the platform is naturally buoyant, the tendons are under constant tension which generally shortens the life of the tie down system.

Another factor to be considered is cost. Generally, the type of large gravity based structure that may be used for arctic exploration and production is very expensive and time consuming to build. With the unproven nature of some of the oil prospects, the harshness of the environment, the increased costs due to the weather down time, the probability of failure, and even the political climate, it becomes even more risky for an oil company to invest a large amount of money or time. In the event of an accident or other type of misadventure, losses could be greatly multiplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy or ballast and a subbase upon which the platform may rest. This structure may then be floated to a drilling or production site and slowly filled with ballast until both the platform and the subbase rest on the sea floor. When a situation, threatening to the structure, presents itself, the platform may be deballasted and removed from the site to leave the subbase behind. However, this deballasting procedure is quite slow (on the order of 6 to 7 hours) and since it is probably going to be done in rough seas, there is a large chance that the structure may be damaged when it "bounces around" as it approaches neutral buoyancy, but before it reaches its floating draft.

A solution to this problem is to keep the platform down on the subbase with a hold-down means while it is being deballasted. Once it has fully deballasted, the hold-down means may then be released to allow the platform to quickly ascend to its floating draft and escape damage.

This hold-down system may be mechanical or hydraulic, however, because a mechanical system: may not assure a simultaneous release of all mechanical systems; is expensive; and difficult to re-use, a hydrostatic sealing system is chosen. This hydrostatic system will hold the structure to the base from the beginning of the deballasting procedure to the time when deballasting is complete. When this occurs, the structure may be quickly detached by releasing the seal and then floated away from the impending danger.

To eliminate most of the problems of these previously-mentioned arctic structures for use in ice-infested waters, the Removable Bottom Founded Structure (RBFS) was developed to provide a platform which may be removably detached from its base with the help of the aforementioned seals and, if necessary, transported to a safer location.

SUMMARY OF THE INVENTION

The present invention holds a buoyant platform onto a subbase that rests on the sea floor. The platform is called a Removable bottom Founded Structure (RBFS) and it is designed for the arctic environment. The RBFS resembles a very large submersible drilling platform which, by virtue of its direct access to the wells, functions in many ways like a conventional fixed drilling and production platform. Normally the platform would be fully ballasted on the subbase with a combination of water and solid ballast. However, in the event of an approaching iceberg (larger than one which the RBFS is designed to resist), the sealing system is engaged, the platform is deballasted to a positive buoyancy condition, the risers are disconnected from the subbase, then the sealing system is released, and the platform floats, and propels itself off location to leave the subbase behind. In this design environment, the platform must disconnect from the subbase and reach its floating draft very quickly to avoid potential collision between the platform and subbase. Here, the hold-down system keeps the platform down on the subbase, and when the columns and braces are deballasted to achieve a large net buoyant upward force, the hold-down mechanism is quickly released to lift off the platform.

To provide an appropriate lift-off mechanism, a system of redundant, elastomeric, lip-type seals are arranged on the underside of the platform in a concentric arrangement. Once the seals are engaged the hydrostatic head underneath the column is reduced by evacuating the ambient water. The platform stays in place during this time by effectively removing the buoyancy forces from the underside of the columns; thus the platform alone holds itself down as if it were not resting on water. The platform will remain on location until the difference in hydrostatic head between the area underneath the column and the outside environment is destroyed.

DETAILED DESCRIPTION OF THE INVENTION

The Removable Bottom Founded Structure (RBFS) is an offshore structure for petroleum drilling and producing operations and is intended for deployment in waters with severe weather and iceberg conditions. The RBFS is a two-part structure. The first part generally comprises a platform and is made up of multiple columns which are connected to a deck structure. The second component is a reinforced concrete subbase that rests on the sea floor and upon which platform is founded.

The RBFS is designed to withstand severe conditions of wind, wave and current action, and many of those ice conditions which could normally be expected during the structure's life. For example, the RBFS was designed to withstand a 150-year return period storm; an iceberg with a 20-year return period kinetic energy; and to survive (with some damage) on impact with an iceberg having a 100-year return period kinetic energy. However, if an iceberg large enough to cause damage to the RBFS threatens to come in contact with the structure, the platform is evacuated from the site, to leave the subbase behind. To ensure that the inhabitants and operators of the RBFS are apprized of all iceberg and storm dangers, they maintain visual lookouts for good days and shorter distances, whereas they use a radar system for longer distances and less clear weather. Danger zones, having specified radii, may also be established to allow the platform personnel to gauge the possibility of actual iceberg incursion.

Figure 1:
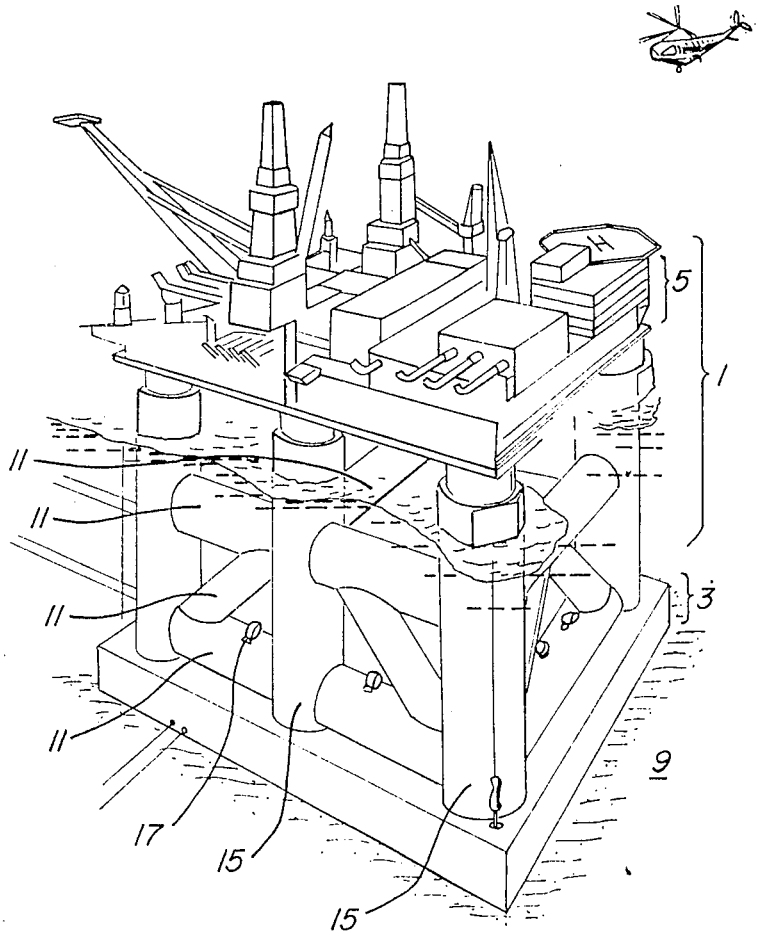
FIG. 1 is a view of the assembled platform resting on the subbase.

FIG. 1 shows that the RBFS comprises two portions, a platform 1 and a subbase 3. The platform 1 is comprised of a deck 5, columns 15, and braces 11. The subbase 3 is affixed to the sea floor 9 and provides a surface to receive axial and lateral loads from the platform 1.

The subbase 3 is a permanent reinforced concrete structure, the configuration of which is generally shown in FIG. 1. It is designed to withstand a 100-year iceberg impact with practically no movement and no structural damage and is able to survive a 2000-year iceberg (while protecting a subsea template) with limited damage. The subbase 3 provides a bearing surface for vertical and lateral load transfer from the platform 1 and protects the well template from iceberg scour.

To prevent potential collision between the platform 1 and the subbase 3 during an iceberg avoidance operation, the platform 1 must rise quickly to its floating draft, otherwise the platform may come in contact with the subbase 3. Furthermore, to shorten the overall iceberg avoidance procedure, the platform 1 must be deballasted concurrently with other iceberg avoidance operations such as shutting in wells and purging and disconnecting the risers. To hold the platform 1 onto the subbase 3 while deballasting (and becoming more buoyant) the hydrostatic pressure that acts on the platform 1 must be reduced. To accomplish this, a system of seals enclose a chamber 51 underneath the column 15. After the chamber 51 bordered by this system of seals, the column 15, and the subbase 3 is separated from the outside seawater, the hold-down system is activated in the following manner. The water in the chamber 51 is evacuated which reduces the buoyancy forces acting on the bottom of the column, thereby effectively holding the platform 1 onto the subbase 3.

There may be times when the platform 1 will have to be moved from its location due to a threatening iceberg. However, before it can abandon site, it must be deballasted. As mentioned before, if it is deballasted and permitted to slowly rise off the subbase, rough waters may cause the platform 1 to come in contact with the subbase 3. This could damage both the platform 1 and the subbase 3 and may even go so far as to cause the platform 1 to flood and sink. As a result, the platform 1 is held down onto the subbase 3 by a hydrostatic hold-down system while it is being deballasted. Once a sufficient amount of liquid ballast has been removed, the hold-down system may be disengaged and the platform 1 allowed to rise to its floating draft in a rapid fashion.

Figure 7:
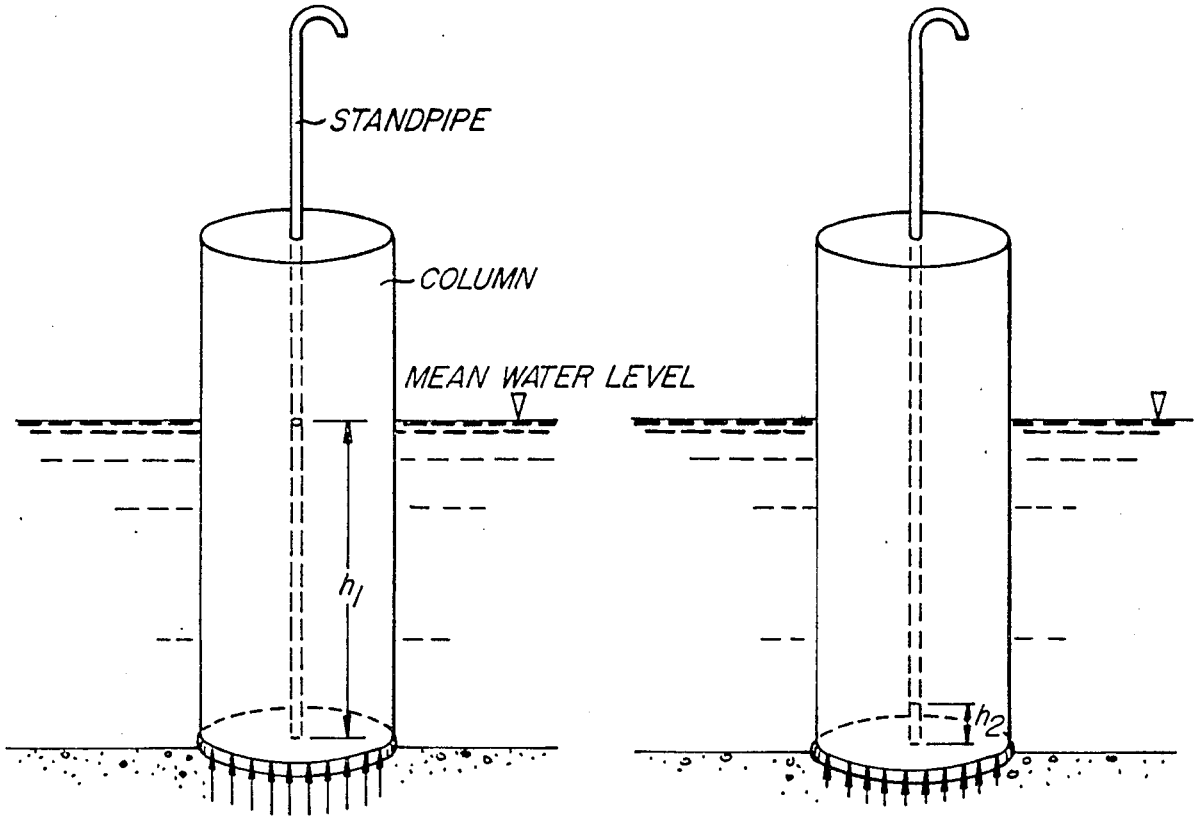
FIG. 7 represents the forces that act on the underside of a buoyant column.

The hydrostatic hold-down system reduces the hydrostatic head on the area underneath the column 15. FIG. 7 represents the buoyancy forces acting on a column before and after the sealing system is engaged. In normal states, the buoyant force that acts on a column may be shown by $P_1=\delta \cdot h_1 \cdot A$ where $P_1$ is the total buoyant force, $\delta$ is the density of water, $h_1$ is the height of water in the standpipe, and A is the area underneath the column. However, operation of the hold-down system reduces the water level in the standpipe to $h_2$. This decreases the buoyant force to a new value which can be expressed as $P_2=\delta \cdot h_2 \cdot A$. The difference in hydrostatic pressure between the outside environment and the area underneath the column is maintained by the seals around the perimeter of the column which keeps the platform 1 on location.

The hold-down system is shown in FIGS. 2–6*b*. A circularly arranged seal underneath the column 15 encloses a hold-down chamber 51 between the column 15 and the subbase 3. During normal platform operatior the RBFS behaves as a gravity structure. Because a hold-down force is not needed, the chamber 51 is open to the ambient hydrostatic pressure. As the platform 1 is deballasted and becomes more buoyant, the hydrostatic pressure in the chamber 51 is reduced by withdrawing water from the chamber 51 to create a hold-down force. The hold-down force equals the product of the plan area of the chamber 51 and the differential pressure, which is $\Delta P=\delta(h_1-h_2)$ (the differential pressure is the ambient hydrostatic pressure at the top of the subbase 3 less the pressure in the chamber 51 which corresponds to the water level in the chamber 51 ). The sum of the hold-down forces in each chamber 51 would be sufficient to prevent uplifting of the platform 1 under the combined effects of the buoyancy of the deballasted platform 1 and the design storm loads. The hold-down force could be deactivated by opening the chamber 51 to the ambient hydrostatic pressure.

Figure 2:
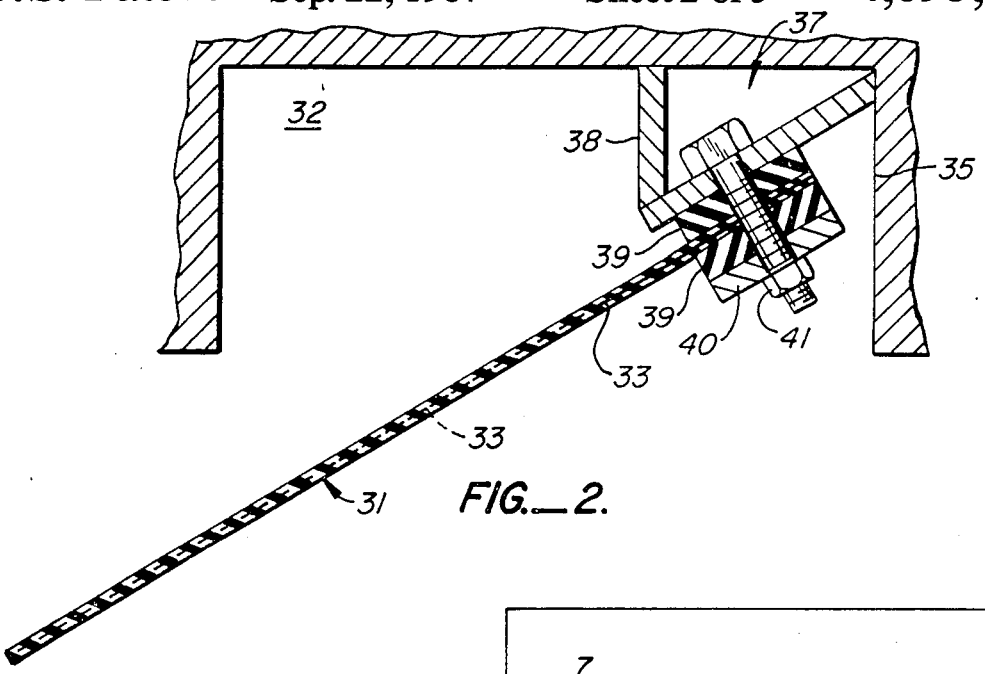
FIG. 2 is an enlarged cross-sectional view of the seal system as it is placed in the column.

A circular lip-type seal 31 is illustrated in cross section in FIG. 2. The seal 31 is approximately 1 m in length, has a radius of approximately 9 m, and is made of a fabric-reinforced elastomer with a fingerlike, stainless steel insert 33. The thin steel insert 33 adds stiffness to the seal 31 to keep it in contact with the subbase 3 and to resist a differential pressure in operation. The insert 33 is in the configuration of a multitude of "fingers" which gradually reduces the stiffness of the seal 31 in the region of contact with the subbase 3. However, it remains stiffer in the area closer to the mounting assembly. The steel insert 33 also helps the seal 31 to retain its original shape.

The seal 31 is placed in a seal chamber 32 (in the underside of the column 15 ) and is attached to a chamber wall 35 via a mounting assembly 37 at a 30° angle relative to the horizontal. The mounting assembly 37 includes a mounting bracket 38, elastomeric strips 39, and a segmental bolting bar 40. It is held in place by a "T" bolt 41. The elastomeric strips 39 fit on each side of the seal 31 along the edge that bolts to the mounting bracket 38. In addition to acting as gaskets, the strips 39 permit some rotation of the stiffened seal 31 where it is bolted to the bracket 38. This will help prevent wrinkling of the seal 31 at the connection when it is under differential pressure loading.

Figure 3:
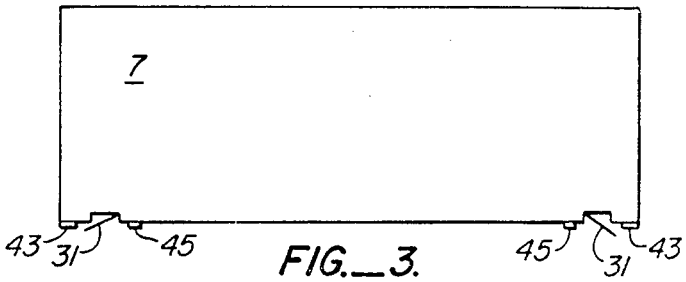
FIG. 3 is a cross-sectional view of the seal system as it is placed in the underside of a column.
Figure 5:
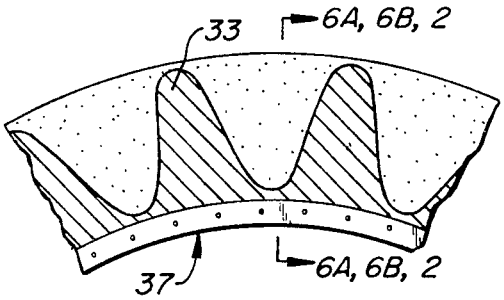
FIG. 5 is an enlarged view of a section of the seal as shown in FIG. 4.
Figure 4:
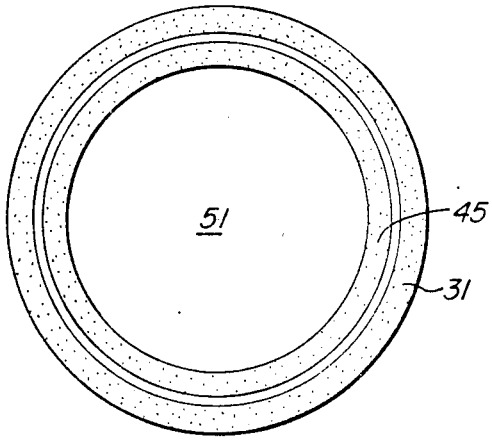
FIG. 4 is a plan view of the seal system.

The seal is also shown in cross section as it appears on the underside of the column 15 (see FIG. 3). Also illustrated is a bearing plate 43 to transmit the axial load from the platform 1 to the subbase 3. There may be another seal 45 within the radius of the seal 31. This seal 45 may be used to provide additional sealing means. FIG. 4 is a plan view of the seal 31 which defines the hold-down chamber 51. FIG. 5 is an enlargement of a section of the seal 31 as shown in FIG. 4.

Figure 6A:
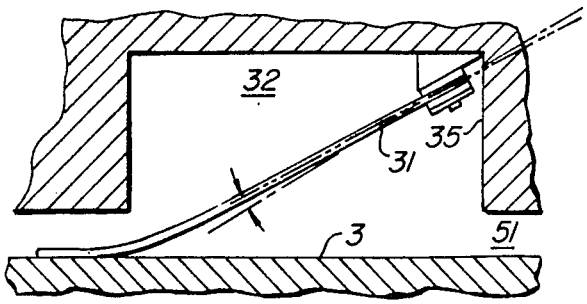
FIG. 6*a* is a cross-sectional view of the seal as it exists when the platform is on location.
Figure 6B:
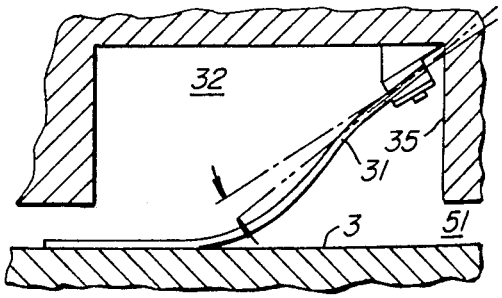
FIG. 6*b* is a cross-sectional view of the seal as it exists when the platform is on location and the space behind the seal has been evacuated.

FIG. 6*a* illustrates the seal 31 as it engages the subbase 3 in the usual configuration. Since the seal 31 is placed at a 30° angle, it contacts the subbase 3 and is deflected. The stiffness of the inner portion of the seal 31 provides the resistance that is needed to hold the seal 31 in contact with the subbase 3. To reduce the hydrostatic head in the hold-down chamber 51, essentially all of the water is pumped out of the chamber 51. This results in a pressure differential between the chamber 51 and the outside environment to force the flexible elastomeric seal 31 down onto the subbase 3 in a more positive manner (as shown in FIG. 6*b*). As the differential pressure increases, the seal 31 tends to deform inward. The stiffness of the seal 31, and the frictional resistance of the portion in contact with subbase 3, prevents the seal 31 from being sucked into the hold-down chamber 51. At this point, the seal 31 provides an essentially fluid-tight barrier between the hold-down chamber 51 and the outside environment, and the lower hydrostatic head underneath the platform 1 is maintained.

Operation of the hydrostatic hold-down system is not necessary for the RBFS during normal operating conditions (because it is normally held in place by gravity), however, the seals would be frequently tested for leaks. Prior to site evacuation, the seals are engaged once the area defined by the seals has been pumped out, and the platform 1 would be deballasted by pumping out the ballast chambers. The pumps are sized such that the entire platform 1 can be deballasted in five hours. Redundant control of ballast tanks from several independent pumps is designed into the system, and ballast control is fully automated with manual backup.

If the seals are effective, then essentially all the water in the space 51 will be removed. A float valve (not shown) may be used to turn off a pump when the water is gone and may reactivate the pump in the event of water leakage into the space 51. While the platform 1 is fully deballasted and the seals have been engaged, the various mechanical systems are prepared for liftoff.

Since the RBFS is intended to evacuate the site on impending impact of a large iceberg, all piping and control lines between the platform 1 and subbase 3 are readily disconnectably. (None of the following material is illustrated.) Therefore, the next step before site evacuation is and hydraulically disengage a riser mechanical latching system to lift the entire integrated riser bundle up into the column 15 by means of hydraulic hoists. The production and injection wells and oil sales lines are shut in subsea and all lines in the integrated riser are purged with seawater. This is the final preparatory step in the liftoff procedure.

Once it has been determined that it is time to move, the platform 1 may be lifted off the subbase 3 by destroying the difference in the hydrostatic pressure between the space 51 and the outside seawater. To equilibrate the pressure in the space (to that of the seawater) additional pressure may be used from such things as pumps, etc., but an easier way to destroy the pressure differential would be to allow water at that depth to flow into the space 51 from the outside. Once that is done the pressure on both sides of the seal 31 will be equal and the natural buoyancy of the platform 1 will cause to rise. Immediately after the platform 1 lifts off the subbase 3, the platform 1 moves away under positive navigational control achieved with a thruster system built into the platform 1. Thrusters 17 (see FIG. 1) may be positioned on the platform 1 to steer the platform 1 in a controlled manner, but not to station keep in severe weather states. Tugs in the vicinity (for iceberg towing, surveillance and other purposes) provide further steering control once sea conditions permit attachment of towing lines.

When sea and ice conditions again permit, the platform 1 is resited on subbase 3 and platform 1 is reballasted. The integrated riser bundle (this system is not shown) is stabbed into its receptacle in subbase 3, hydraulic hoists are used to stab a riser connector down onto a connector mandrel, and integrated riser is reconnected to the wellhead. Drilling risers (also not shown) are also reattached to well template through a moonpool and the normal operations are again resumed.

Since many modifications and variations of the present invention are possible within the spirit of this discl sure, it is intended that the embodiments disclosed are only illustrative and not restrictive. For that reason, reference is made to the following claims rather than to the specific description to indicate the scope of this invention.

What is claimed is:

1. A sealing apparatus to affix a gravity founded, movable offshore structure onto a subbase that rests on the sea floor, during the time when the movable structure is being deballasted to prepare for rapid site removal, comprising:

a movable offshore platform;

at least one load bearing member to support the platform, the member is fixedly connected to the platform and extends in a generally downward direction from the platform;

a generally flat surface on the underside of the member;

a subbase located on the sea floor to provide support to the platform;

a generally flat upper surface on the subbase to support the member on the upper surface of the subbase;

means for creating a space between the subbase and the member;

a reinforced, elastomeric lip seal membrane fixedly connected to the bottom of at least one support member in a closed loop for primary sealing purposes, the membrane being able to contact the subbase once a portion of the platform weight forces the membrane down onto the subbase; and means to evacuate the space between the lip seal, the subbase, and the pontoon, to reduce the hydrostatic pressure lower than the surrounding seawater so that when the space has been evacuated the platform is held onto the subbase until the hydrostatic pressure in the evacuated space is restored to equilibrium with the outside sea environment.

2. The sealing apparatus as recited in claim 1 wherein the lip seal is circularly arranged on the underside of the member.

3. The sealing apparatus as recited in claim 2 wherein there is also an inner seal, for secondary sealing purposes, that is concentrically arranged inside the lip seal membrane.

4. The sealing apparatus as recited in claim 1 wherein the lip seal membrane is mounted in a recessed compartment in the member.

5. The sealing apparatus as recited in claim 1 wherein the lip seal membrane is mounted so that said membrane is approximately 30° to the plane of the subbase.

6. The sealing apparatus as recited in claim 1 wherein the member is a load bearing column.

7. The sealing apparatus as recited in claim 1 wherein the member is a pontoon.

8. A sealing apparatus to affix a gravity founded, movable offshore structure onto a subbase that rests on the sea floor, during the time when the movable structure is being deballasted to prepare for rapid site removal, comprising:

a movable offshore platform;

a load bearing member to support the platform, the member being fixedly connected to the platform;

a generally flat surface on the underside of the member;

a subbase located on the sea floor to provide support to the platform;

a generally flat upper surface on the subbase to support the member on the upper surface of the subbase;

means for creating a space between the subbase and the member;

a recessed compartment in the underside of the member;

a first, fabric-reinforced, laminated, elastomeric lip seal mounted in a circular arrangement in the recessed compartment at approximately 30° relative to the upper surface of the subbase, the lip seal is able to contact the subbase once a portion of the platform weight forces the lip seal against the subbase;

a second, inner, fabric-reinforced, laminated, elastomeric lip seal concentrically mounted in the recessed compartment at approximately 30° relative to the upper surface of the subbase for secondary sealing purposes;

stainless steel inserts placed within the first and second seals to provide support for the seals; and means for evacuating the space between the subbase, the member, and the lip seals to reduce the hydrostatic pressure to a lower pressure than the surrounding seawater, so that when the space has been evacuated the platform is held onto the subbase while it is being deballasted until such time as the hydrostatic pressure in the evacuated space has been restored to equilibrium with the outside sea environment.

* * * * *